US005165162A

United States Patent [19]

Charles

[11] Patent Number: 5,165,162

[45] Date of Patent: Nov. 24, 1992

[54] METHOD FOR MAKING A SEGMENTED TOROIDAL INDUCTOR

[75] Inventor: Richard J. Charles, Schenectady, N.Y.

[73] Assignee: General Electric Company, Schenectady, N.Y.

[21] Appl. No.: 760,556

[22] Filed: Sep. 16, 1991

Related U.S. Application Data

[63] Continuation-in-part of Ser. No. 632,878, Dec. 24, 1990, abandoned.

[51] Int. Cl.[5] ..... H01F 7/06

[52] U.S. Cl. ..... 29/605; 29/607; 336/229

[58] Field of Search ..... 29/605, 607-609; 336/178, 219, 229, 62

[56] References Cited

U.S. PATENT DOCUMENTS 1,420,989 6/1922 Fondler .
2,382,857 8/1945 Camilli ..... 175/356
2,446,999 8/1948 Camilli ..... 175/356
3,014,170 12/1961 Nygard ..... 321/15

FOREIGN PATENT DOCUMENTS 19919 of 1914 United Kingdom .
350989 12/1929 United Kingdom .

*Primary Examiner*—Carl E. Hall
*Attorney, Agent, or Firm*—Jill M. Breedlove; Marvin Snyder

[57] ABSTRACT

A small, high-frequency, high-efficiency inductor includes a segmented toroidal core with a winding wound thereon. The toroidal core has either a solid core structure, a laminated core structure, or a strip-wound core structure that is cut into segments. The segmented toroidal core is made of a relatively high-permeability magnetic material and has a plurality of narrow gaps having a width less than approximately 2% of an average linear dimension across the face of each segment. Nonconductive, nonmagnetic spacers are inserted and bonded in the gaps. The inductor winding preferably comprises litz wire in order to further reduce losses.

14 Claims, 5 Drawing Sheets

METHOD FOR MAKING A SEGMENTED TOROIDAL INDUCTOR

This is a continuation-in-part of application Ser. No. 632,878, filed Dec. 24, 1990, now abandoned.

FIELD OF THE INVENTION

The present invention relates generally to magnetic circuit components. More particularly, the present invention relates to a small, high-efficiency inductor and a method for making same.

BACKGROUND OF THE INVENTION

Conventional magnetic circuit components, such as inductors, are comprised of a high-permeability magnetic material and include one or two air gaps to control inductance. Although the size of such a magnetic component can be decreased by increasing the operating frequency, core and winding losses increase as frequency increases. These increased losses are due, in part, to nonuniform fringing fields about the air gap which cause undesirable eddy currents in the core and winding. Hence, there is a trade-off between size and efficiency of magnetic circuit components.

OBJECTS OF THE INVENTION

Accordingly, an object of the present invention is to provide a small, high-efficiency inductor.

Another object of the present invention is to provide a small inductor configured so as to minimize external flux, thereby minimizing eddy current losses.

Still another object of the present invention is to provide a method for manufacturing a small, high-efficiency inductor.

SUMMARY OF THE INVENTION

The foregoing and other objects of the present invention are achieved in a small, high-efficiency inductor comprising a segmented toroidal core with a winding wound thereon. In a preferred embodiment, the segmented toroidal core is comprised of a relatively high-permeability magnetic material and has a plurality of (i.e., at least, but preferably greater than, three) relatively narrow gaps in which dielectric spacers are inserted and bonded. Preferably, the winding wound about the segmented toroidal core comprises litz wire in order to further reduce losses.

A method for making a small, high-efficiency inductor of the present invention involves: (1) shaping, such as by molding and sintering, the individual segments of the toroidal core; (2) finish machining, such as by surface lapping or grinding, each segment so that the gaps of the toroidal core, when assembled, will have smooth and parallel walls; (3) bonding nonconductive, nonmagnetic shims in the gaps between the core segments; and (4) disposing the winding about the core. In an alternative embodiment, fractional portions of the toroidal core, e.g. half-toroids, are assembled and then wound with corresponding portions of the winding, after which the fractional portions of the core are bonded together and the winding portions are electrically connected together. In another alternative embodiment, each fractional portion of the toroidal core may be disposed within a nonconductive, nonmagnetic casing either by insertion in pre-formed casing segments which abut the end surfaces of the core segments or by forming the casing in place around abutting core segments.

By the latter method, the casing acts to ensure that the winding is spaced apart from the core gaps, further reducing core losses.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
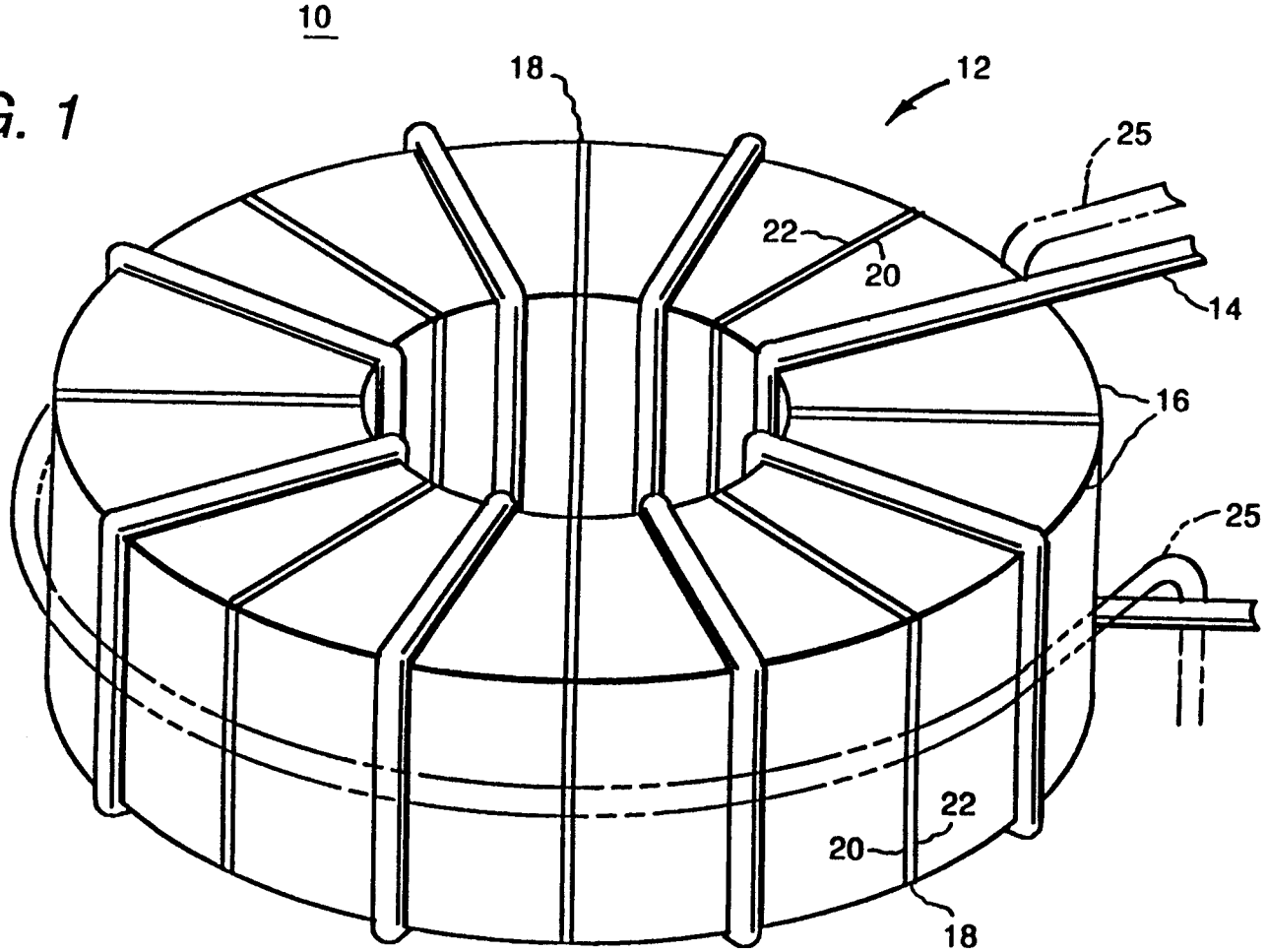
FIG. 1 illustrates a segmented toroidal inductor in accordance with a preferred embodiment of the present invention.

FIG. 1 illustrates a segmented toroidal inductor 10 in accordance with a preferred embodiment of the present invention. Inductor 10 includes a toroidal core 12 with a winding 14 wound thereon. The toroidal core is divided into a plurality of (i.e., at least, but preferably greater than, three) segments 16 by radial gaps 18.

In one preferred embodiment, toroidal core 12 comprises a low-loss, high-permeability magnetic material, such as that sold under the trademark K2 by Magnetics, Inc., which has a permeability $\mu$ on the order of 2000 in the frequency range from approximately ½ MHz to 2 MHz. The toroidal core may comprise, for example, either a solid core structure, a laminated core structure, or a strip-wound core structure (i.e., a strip of magnetic material wound about a central axis to form a toroid) that is cut into segments 16. A preferred toroidal core diameter is in the range from approximately ½ to 4 inches. Gaps 18 are relatively narrow in order to minimize fringing flux at the corners of segments 16 which tends to cause circulating currents in the winding. For example, for a toroid having an outside diameter in the range from approximately 0.6 to 1.5 inches, maximum efficiency has been achieved with gaps not exceeding 0.01 inch in width. Moreover, the gap width should not exceed approximately 2% of an average linear dimension across the face of each segment to ensure that the magnetic losses of the final toroidal structure are not substantially more than the bulk loss of the material without air gaps. For a particular application, however, optimum gap size depends on a number of factors including frequency, number of gaps, type of winding, and size of the inductor.

As an additional feature of the segmented toroidal core of the present invention, gaps 18 have parallel sides 20 and 22 in order to ensure uniform flux in the core, thereby reducing core losses. A suitable spacer for insertion and bonding into each gap 18 may comprise, for example, glass, ceramic, polyimide, polystyrene or epoxy. Winding 14 preferably comprises litz wire, i.e. a plurality of transposed, insulated strands of wire, in order to further minimize losses by avoiding circulating currents between the conductors of the winding.

Advantageously, the toroidal core structure minimizes the external field flux about the inductor. However, to further reduce the external field flux, a single reverse-turn wire 25 may be employed in well-known fashion, as shown in phantom in FIG. 1, to cancel at a distance the external field caused by the effective one-turn conductor about the core resulting from the presence of the toroidal winding thereon. That is, the reverse-turn conductor 25 serves to cancel at a distance the external field component resulting from the component of current in the winding which follows the path of said core.

Figure 2:
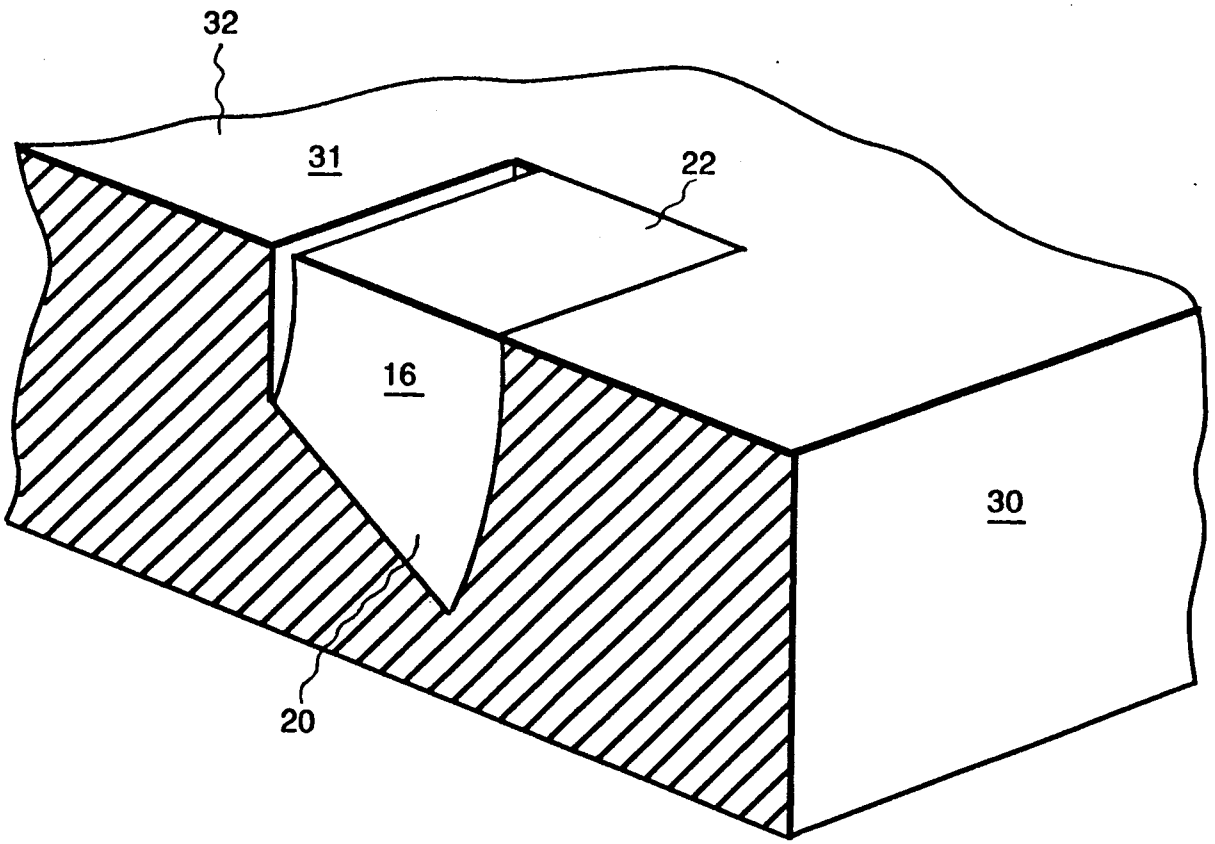
FIG. 2 illustrates a mold for containing a segment of the toroidal inductor of FIG. 1 which is useful in a preferred method of making same.

A preferred method for making a segmented toroidal inductor of the present invention first involves molding the segments by, for example, die pressing, or extrusion and slicing, or slip casting. Next, the resulting segments are sintered. Each segment is then placed in a mold 30 having a cavity 31 of a predetermined shape corresponding to the desired segment configuration, such as that shown in FIG. 2. The walls 20 and 22 of each segment 16 which will form the walls of gaps 18 (FIG. 1) are surface lapped or ground so that they are smooth and parallel. Specifically, with segment 16 oriented in mold 30 as shown in FIG. 2, wall 22 is ground to be parallel with the upper side 32 of mold 30. After wall 22 has been ground to the proper size and smoothness, segment 16 is reoriented in mold 30 to enable grinding of wall 20 in similar fashion. Furthermore, although each segment is of substantially the same size in one embodiment, the advantages of the present invention may be achieved using segments of different sizes, if desired. The segments are then assembled to form a segmented toroidal core with dielectric shims bonded between each segment. The thickness of the shims depends on the desired gap width. Moreover, to adjust final inductance, gap width may be increased or decreased by moving the segments radially outward or inward, respectively, while maintaining the parallel relationship of the gap walls.

Figure 3A:
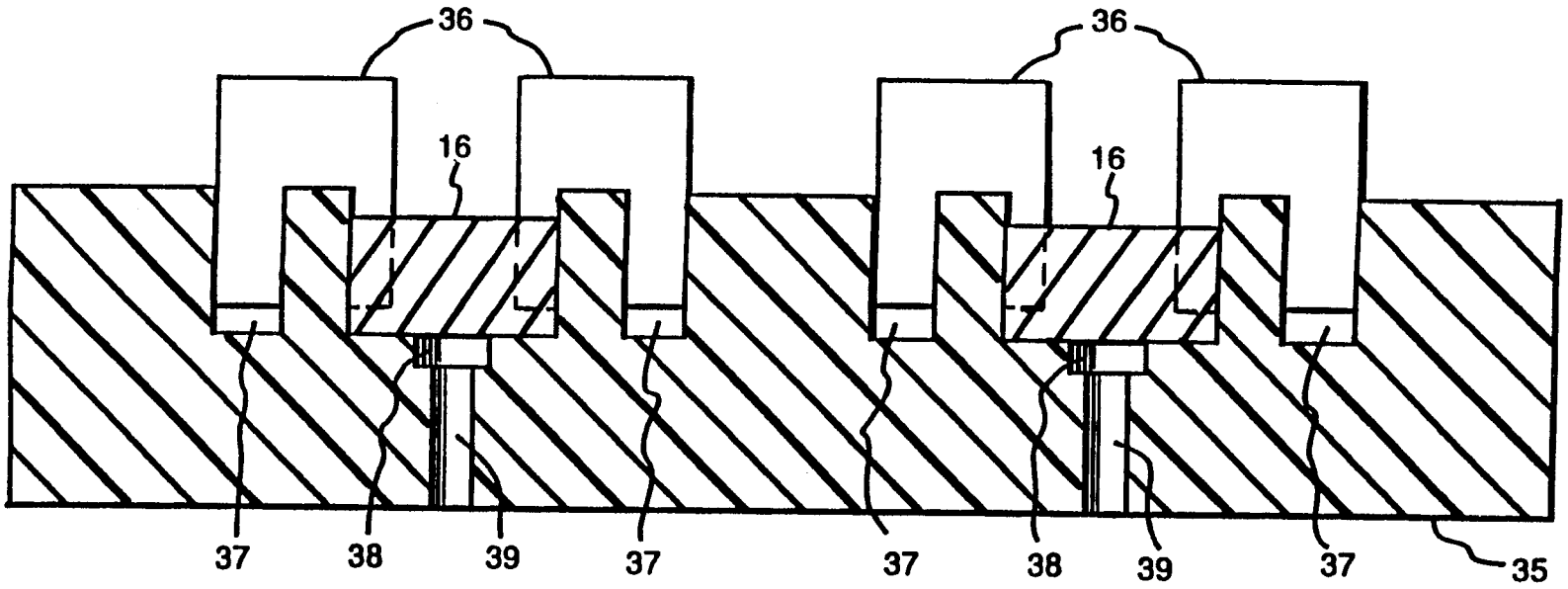
FIG. 3A is a cross sectional view and FIG. 3B is a partial perspective view illustrating one preferred method of assembling the segmented toroidal core of the present invention.
Figure 3B:
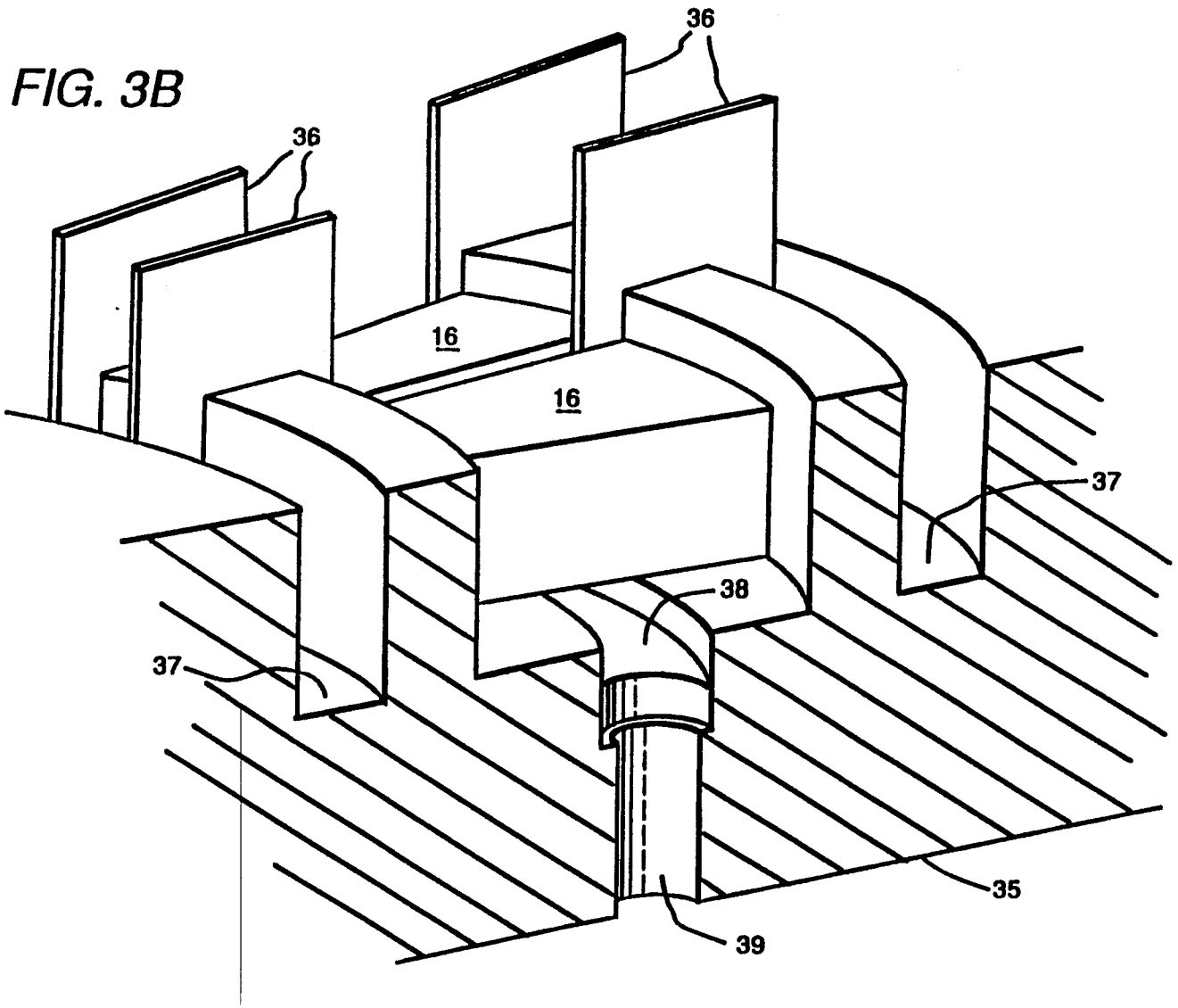

One preferred method of assembling the toroidal core so as to ensure substantially constant, uniform gaps is to insert the segments in a toroidal mold 35, shown in a cross sectional view in FIG. 3A and in a partial perspective view in FIG. 3B. One leg of each of two substantially U-shaped dielectric shims 36 is inserted between adjacent segments so that each other leg of the U-shaped members fits into a trough 37 of mold 35. Preferably, each leg of each shim 36 occupies approximately 5–15% (e.g., 10%) of the surface area of each segment. (Although two U-shaped shims are shown and described, it is to be understood that one or more shims of any suitable shape may be employed as long as the faces of the adjacent segments are maintained parallel to each other, and the correct gap width for the particular application is achieved.) Suitable dielectric shims 36 are machined from sheets of, for example, polyester film, such as that sold under the trademark Mylar by E. I. du Pont deNemours and Company. A preferred thickness of the dielectric shims is in the range from approximately 1 to 20 mils, with a more preferred range being in the range from approximately 3 to 10 mils. The final total gap is determined by the sum of the individual gaps between the segments. A bonding material, such as epoxy, is then poured through the toroid so as to fill in the remaining spaces between the segments. Excess bonding material flows into channels 38 and out of the structure via drain holes 39. The resulting structure is then machined so that the final dimensions of the toroid conform to the particular device specifications.

According to one preferred method, the toroidal core is completely assembled before winding the core using well-known toroidal core-winding methods. Alternatively, separate fractional portions, e.g. half portions, of the toroidal core are assembled and then wound with corresponding portions of the winding before completing the core and electrically connecting the portions of the winding together, e.g. in series or in parallel.

Figure 4:
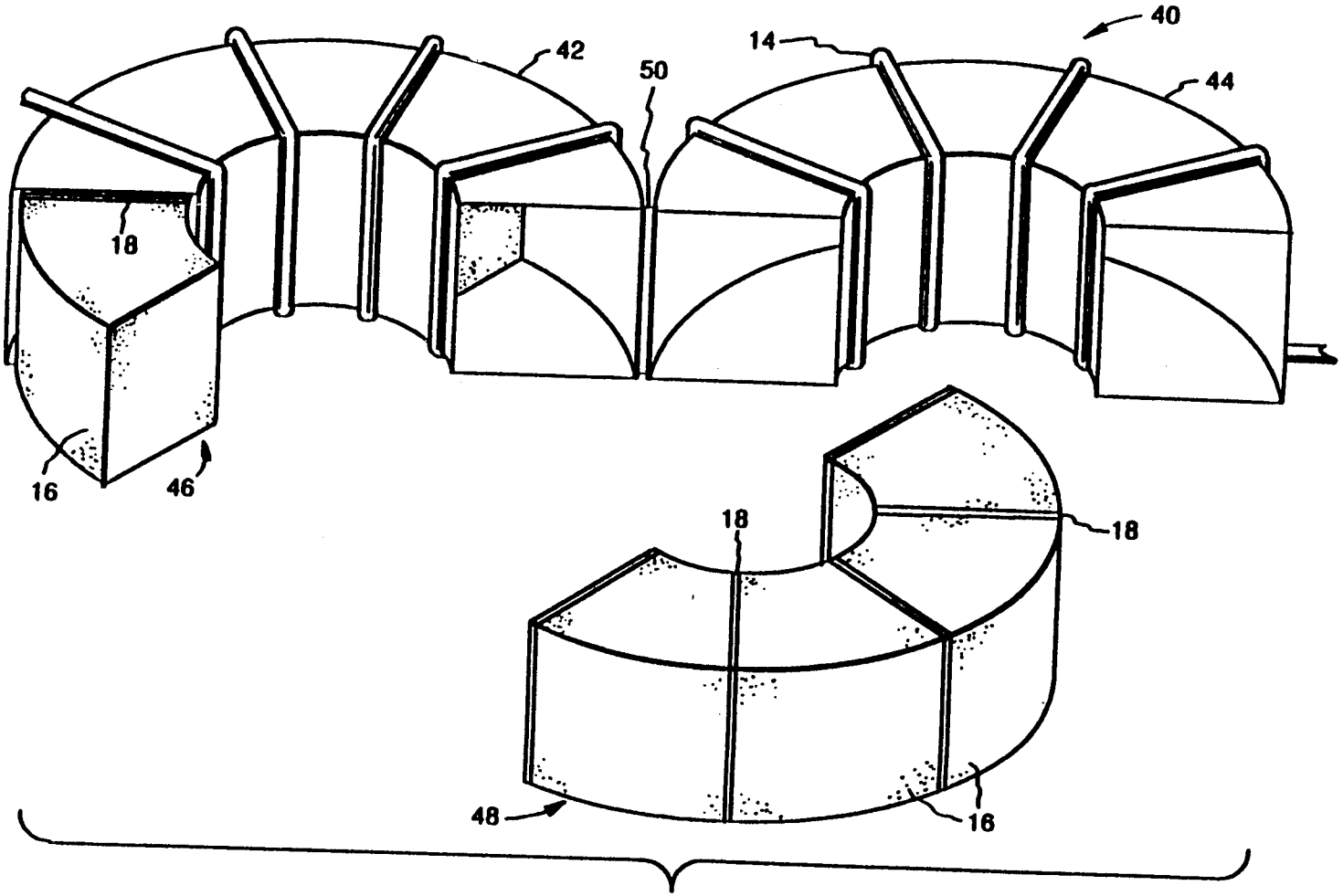
FIG. 4 shows an intermediate configuration of a toroidal inductor of the present invention during assembly thereof in accordance with another preferred method of manufacture.

In still another alternative method of the present invention, the shims and segments may be encased in a casing 40, as illustrated in FIG. 4. By way of illustration, FIG. 4 shows two casing segments 42 and 44 for receiving the corresponding fractional portions of the core. A portion of winding 14 is wound about each casing segment 42 and 44 either before or after insertion of the fractional portion of the core. Casing 40 advantageously ensures that winding 14 is spaced apart from core 12, and, more importantly, the gaps 18, in order to minimize losses. The casing segments are shown as being connected by a hinge 50 which is closed after each casing segment is wound and each fractional portion of the core is inserted therein. With the casing segments connected together, the portions of the winding are electrically connected together, e.g. in series, to complete assembly of winding 14.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for making an inductor having a segmented toroidal core with a plurality of radial gaps and a winding wound thereon, comprising the steps of:

shaping each segment of said toroidal core;

finish machining each said segment so that each has substantially the same size and shape;

assembling said toroidal core in a toroidal mold;

inserting dielectric shims between adjacent segments, each of said shims covering a portion of the adjacent surface area of each segment in the range from approximately 5%–30% thereof;

filling the remaining space between adjacent segments with a bonding material, adjacent surfaces of adjacent segments of said core being substantially parallel;

winding a conductor about said toroidal core.

2. The method of claim 1 wherein said dielectric shims extend beyond said segments, said method further comprising the step of machining said toroidal core to predetermined dimensions before the winding step.

3. The method of claim 1 wherein two of said dielectric shims are inserted between adjacent segments, each of said shims covering approximately 5–15% of the surface area of said segments.

4. The method of claim 3 wherein said dielectric shims are substantially U-shaped, one leg of each of said U-shaped shims being inserted between adjacent segments, said method further comprising the step of machining said toroidal core to predetermined dimensions before the winding step.

5. The method of claim 1, further comprising the steps of:

enclosing said toroidal core in a casing before the winding step, said casing being disposed between said core and said winding.

6. The method of claim 1 wherein said conductor comprises litz wire.

7. A method for making an inductor having a segmented toroidal core with a plurality of radial gaps and a winding wound thereon, comprising the steps of:

shaping each segment of said toroidal core;

finish machining each said segment so that each has substantially the same size and shape;

assembling a plurality of said segments together to form separate respective fractional portions of said toroidal core in a mold, including inserting dielectric shims between adjacent segments of each respective fractional portion of said toroidal core, each of said shims covering a portion of the adjacent surface area of each segment in the range from approximately 5%–30% thereof, and further including filling the remaining space between adjacent segments with a bonding material, adjacent surfaces of adjacent segments of each respective fractional portion of said core being substantially parallel;

winding a conductor about each of said frictional portions of said toroidal core;

connecting said frictional portions of said toroidal core together; and electrically connecting each said conductor togethe to form said winding.

8. The method of claim 7 wherein said dielectric shims extend beyond said segments, said method further comprising the step of machining said fractional portions to predetermined dimensions before the step of electrically connecting each said conductor together to form said winding.

9. The method of claim 7 wherein two of said dielectric shims are inserted between adjacent segments, each of said shims covering approximately 5–15% of the surface area of said segments.

10. The method of claim 9 wherein said dielectric shims are substantially U-shaped, one leg of each of said U-shaped shims being inserted between adjacent segments, said method further comprising the step of machining said fractional portions to predetermined dimensions before the step of electrically connecting each said conductor together to form said winding.

11. The method of claim 7 wherein the step of electrically connecting each said conductor together comprises electrically connecting each said conductor in series.

12. The method of claim 7 wherein the step of electrically connecting each said conductor together comprises electrically connecting each said conductor in parallel.

13. The method of claim 7, further comprising the steps of:

inserting each said fractional portion of said toroidal core in a casing, each respective conductor being wound about the respective casing.

14. The method of claim 7 wherein said winding comprises litz wire.

* * * * *